US011376712B2

(12) United States Patent
Brice et al.

(10) Patent No.: US 11,376,712 B2
(45) Date of Patent: Jul. 5, 2022

(54) PEENING MEDIA AND PROCESSES FOR PRODUCING AND USING PEENING MEDIA

(71) Applicant: Purdue Research Foundation, West Lafayette, IN (US)

(72) Inventors: David A. Brice, Indianapolis, IN (US); David F. Bahr, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 226 days.

(21) Appl. No.: 16/902,880

(22) Filed: Jun. 16, 2020

(65) Prior Publication Data

US 2020/0391350 A1 Dec. 17, 2020

Related U.S. Application Data

(60) Provisional application No. 62/862,309, filed on Jun. 17, 2019.

(51) Int. Cl.

| | |
|---|---|
| ***B24C 11/00*** | (2006.01) |
| ***C22F 1/18*** | (2006.01) |
| ***B24C 1/10*** | (2006.01) |

(52) U.S. Cl.
CPC ..... *B24C 11/00* (2013.01); *B24C 1/10* (2013.01); *C22F 1/183* (2013.01); *C22F 1/186* (2013.01)

(58) Field of Classification Search
CPC . B24C 11/00; B24C 1/10; C22F 1/183; C22F 1/186
See application file for complete search history.

(56) References Cited

FOREIGN PATENT DOCUMENTS

EP 0578453 A1 * 1/1994 ..... B24C 11/00

* cited by examiner

*Primary Examiner* — Jessee R Roe
(74) *Attorney, Agent, or Firm* — Hartman Global IP Law; Gary M. Hartman; Domenica N. S. Hartman

(57) ABSTRACT

Processes for producing peening media, the peening media produced from such processes, and methods of using such media. Particles are provided having surfaces that are formed of or contain a metal that exhibits solubility for oxygen in a metallic phase so as to increase in surface hardness as a result of solid solution strengthening due to oxidizing of the surfaces of the particles. The particles are subjected to a thermal process in an oxygen-containing atmosphere at a process temperature and for a process duration sufficient to oxidize the surfaces of the particles to increase the surface hardness of the particles while not forming an oxide layer that encases the particles.

20 Claims, 4 Drawing Sheets

PEENING MEDIA AND PROCESSES FOR PRODUCING AND USING PEENING MEDIA

CROSS-REFERENCE TO RELATED APPLICATIONS

This application claims the benefit of U.S. Provisional Application No. 62/862,309, filed Jun. 17, 2019, the contents of which are incorporated herein by reference.

BACKGROUND OF THE INVENTION

This present invention generally relates to peening processes for modifying surfaces of articles. The invention particularly relates to processes for producing peening media, the peening media produced from such processes, and methods of using such media.

Shot peening is a well-established surface treatment commonly used to impart compressive residual stresses in articles to improve their fatigue lives. Depending on the final application of an article, possible drawbacks of this surface engineering process include increased surface roughness from indentations caused by the shot peening media and the potential for contamination of the surface of the article from material transfer to the article from the peening media.

Contamination from peening media can have deleterious effects on properties. Iron-based particles are commonly used as peening media, which if used to peen surfaces of a corrosion resistant alloy can result in poorer corrosion resistance as compared to their untreated counterpart. Particular examples are shot peening of aluminum and magnesium alloys. It has been reported that iron concentration in shot peened magnesium Alloy AZ91 can be as high as 1.5 wt % at the peened surface. Other research using ceramic peening media have indicated no measurable corrosion or fatigue deficit as a result, although contamination from the use of Zirconia ($ZrO_2$) has been reported when used to shot peen titanium alloy Ti-6Al-4V.

One route to circumvent surface contamination of titanium alloys would be to use Ti-based shot peening media. However, the peening media must be harder than the target alloys.

BRIEF SUMMARY OF THE INVENTION

The present invention provides processes for producing peening media, the peening media produced from such processes, and methods of using such media.

According to one aspect of the invention, a process of producing peening media entails providing particles wherein at least surfaces of the particles are formed of or contain a metal that exhibits solubility for oxygen in a metallic phase so as to increase in surface hardness as a result of solid solution strengthening due to oxidizing of the surfaces of the particles. The particles are subjected to a thermal process in an oxygen-containing atmosphere at a process temperature and for a process duration sufficient to oxidize the surfaces of the particles to increase the surface hardness of the particles while not forming an oxide layer that encases the particles.

Other aspects of the invention include shot peening media comprising particles produced by the process described above, as well as peening a surface of an article with particles produced by the process described above, wherein the article is formed of a base metal that is the same as the metal of the particles.

Aspects and advantages of this invention will be appreciated from the following detailed description.

Figure 4:
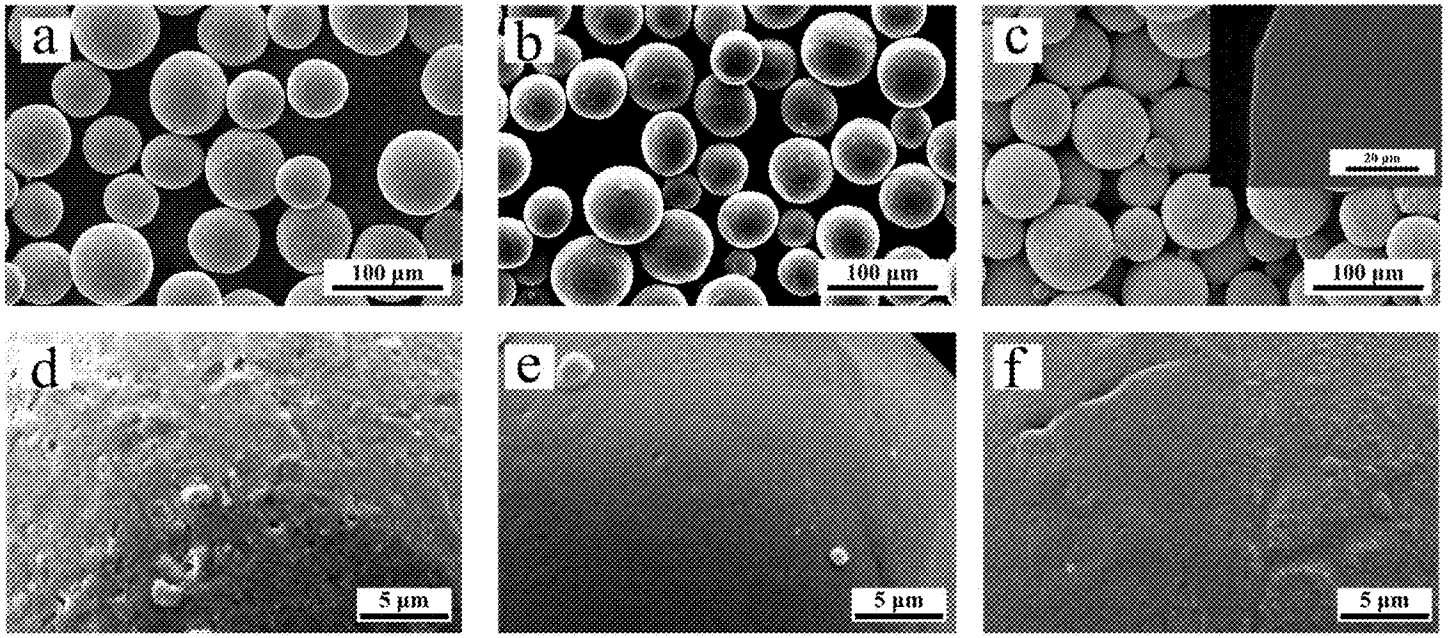

Images a and d of FIG. 4 are SEM images (taken with Everhart-Thornley detector) of Cp-Ti powder in the as received condition. Images b and e of FIG. 4 are SEM images (taken with Everhart-Thornley detector) of powder subjected to 430° C. for 24 hr. Images c and f of FIG. 4 are SEM images (taken with Everhart-Thornley detector) of the powder subjected to 530° C. for 20 hr. Inset (backscattered SEM image) shows that oxide formed on surface is thin.

DETAILED DESCRIPTION OF THE INVENTION

The present invention is generally applicable to components that benefit from the effects of shot peening, including improved fatigue properties, but may also benefit from improved surface finishes. Notable examples of such components include components employed in aerospace, automotive, and biomedical industries. While the advantages of this invention will be described with reference to shot peening of titanium and its alloys (hereinafter, sometimes simply referred to as titanium), the teachings of this invention are generally applicable to any component that benefits from fatigue resistance.

The present invention encompasses methods capable of increasing the surface hardening of titanium particulate media with oxygen, which is a potent alpha stabilizer that provides solid solution strengthening. Investigations reported below demonstrated that exposure of titanium alloy particles (sometimes simply referred to herein as titanium particles) to oxygen under certain thermal conditions increased surface hardness of the particles, in some cases, by a factor of almost three, as a result of solid solution strengthening without creating a distinct oxide layer or significant sintering of particles.

Titanium displays a large solubility for oxygen in the α-Ti phase and the addition of oxygen (referred to herein as oxidizing) to α-Ti is a potent hardener. It is reported in literature that the hardening in titanium from oxygen additions is due to the distortion of the lattice parameters and the increase of the critical resolve shear stress of pyramidal and basal slip systems allowing for prismatic slip to be activated preferentially. In the investigations reported below, the large solubility of oxygen in α-Ti enabled the oxidizing (which, as used herein, is distinct from oxidation) of titanium particles under certain thermal conditions that sufficiently increased the surface hardness of the particles to permit their use as Ti-based shot peening media for titanium alloy articles, thereby avoiding surface contamination of the articles. The thermal conditions also avoided the formation of a titanium oxide ($TiO_2$) layer that encased the particles, which would otherwise increase the potential for incorporating titanium oxides into the articles being peened with the media.

For the investigations, commercially pure titanium powder (99.8% metal basis) was obtained from Atlantic Equipment Engineers (AEE) with an initial composition of, in weight percent, 0.01 hydrogen, 0.02 carbon, 0.02 nitrogen, 0.18 oxygen, and the balance titanium. The powder had a particle size range of 50 to 150 μm. In order to harden the powder particles without sintering or excessive oxidation of the particles, a controlled diffusion of oxygen into the particles must be achieved. Surface engineering of titanium alloys via case hardening procedures is well established, but often the goal is to incorporate a case with a thickness on the order of hundreds of micrometers. Previous researchers have developed a hardening mechanism for bulk titanium structural parts where the material is oxidized at high temperature to produce a distinct oxide layer between 700°-1000° C. The oxide layer is then dissolved into the alloy by a second heat treatment in an inert atmosphere or vacuum.

To avoid excessive oxidation of the titanium particles, substantially different process parameters from previously reported processes were necessary. Such parameters included much lower processing temperatures. Another difference was the requirement to harden titanium particles through oxygen ingress, as opposed to a bulk titanium material. Dilution of oxygen into the titanium particles must be done without sintering because the powder must remain loose to be an effective shot peening media. However, the goals of incorporating oxygen ingress into fine titanium particles and not sintering the particles are processes in opposition to each other: oxidation will occur at a faster rate as temperature increases, but sintering will also be more effective at elevated temperatures, leading to a decrease in spherical morphology that is desired for shot media. Consequently, thermal treatment temperatures below the oxidation start temperature for titanium (550° C.) were explored to minimize the formation of titanium oxide.

Figure 1B:
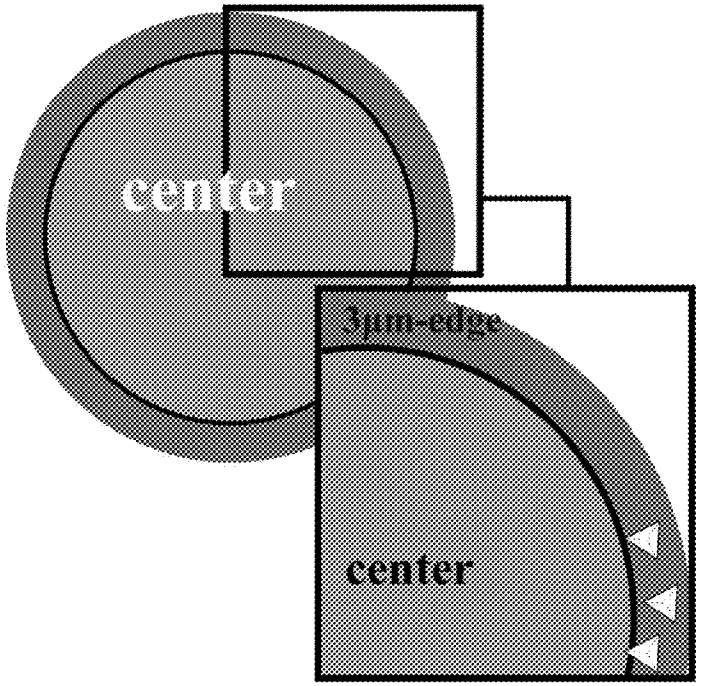
FIG. 1B: Schematic of powder particle cross-section shows that indentations were performed within 3 μm from the surface of the particle and individual indentation locations varied within this band from particle to particle. Black dashed line represents the average hardness of the as received powder's surface (3.0±0.25 GPa), and tire brown dashed line represents the average hardness of age hardened Ti-21S (4.3±0.14 GPa).
Figure 1A:
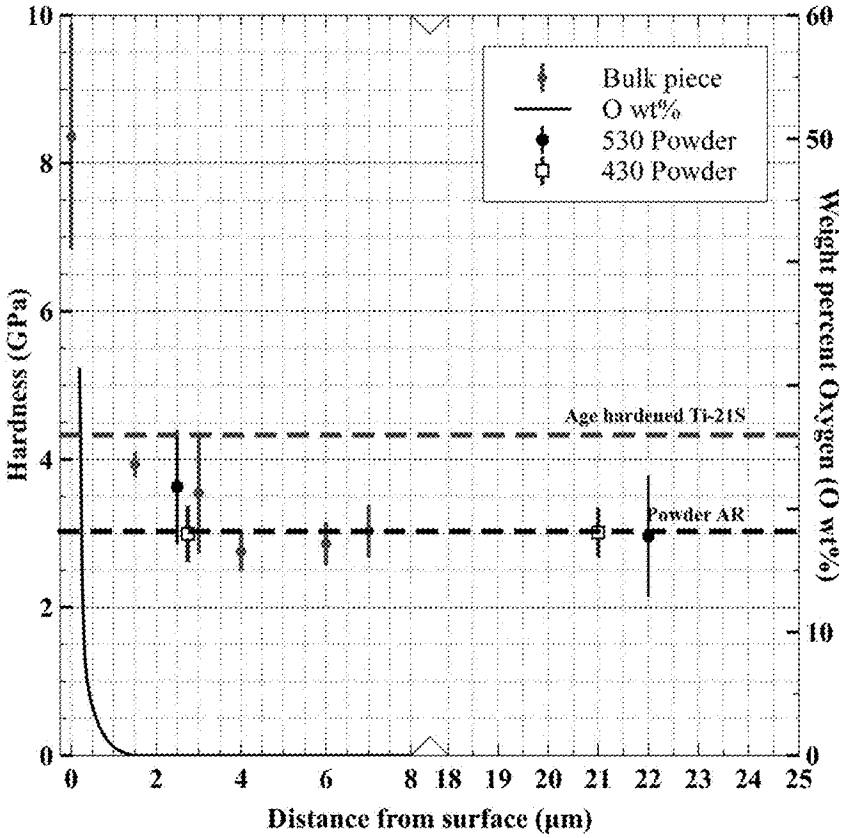
FIG. 1A: Hardness as measured from a bulk titanium specimen and titanium powder samples treated at 430° C. and 530° C. in an ambient atmosphere. The bulk titanium specimen shows a gradual decrease in hardness with increasing distance from tire surface, and is closely matched by powder processed at 530° C. Powder processed at 430° C. showed no significant change in hardness.

To evaluate the extent of hardening from oxygen ingress into titanium at these moderate temperatures, a bulk specimen of commercially pure (CP) titanium was obtained having an initial composition of, in weight percent, 0.015 hydrogen, 0.08 carbon, 0.03 nitrogen, 0.25 (max) oxygen, and the balance titanium. The specimen was ground and polished with colloidal silica, and cleaned by immersion in ultrasonic baths of acetone, propanol, and methanol. The specimen was then heat treated in air at 530° C. for 20 hours. This duration was selected to allow a diffusion length on the order of 2 to 5 μm for oxygen into titanium. The hardness of the surface as treated, and a metallographically prepared cross-section, was evaluated with nanoindentation using a Hysitron Ti 950 Triboindenter with Berkovich lip with an effective radius of 600 nm and a maximum load of 10 mN. All hardness measurements were calculated using the Oliver and Pharr technique. A partial load-unload method was used to acquire hardness as a function of depth of the indentation. For the results presented herein, only the hardness at a depth of about 200 nm is presented (FIG. 1A) since by using a fixed depth any differences due to indentation size effects are minimized.

Samples of the titanium powder were processed at either 430° C. for 24 hours or 530° C. for 20 hours in ambient atmosphere. The lower temperature processing (430° C.) was chosen to determine a window of conditions capable of minimizing the risk of sintering. Following the thermal treatments, the powder samples were milled (rotating roller mill in a Nalgene bottle with no milling media) for 24 hours. The milling step was performed to break up any small clumps of powder that may have formed during the thermal treatment. The loose powders were cold-mounted in epoxy and polished to reveal cross-sectional areas of their particles. Polished specimens were tested with nanoindentation to measure hardening caused by oxygen ingress, and electron microscopy was performed using a FEI Quanta 650. Phase analysts of loose powders was done through X-ray diffraction with a Broker D8 diffractometer. Quantitative depth profiling measurements were taken from the bulk titanium specimen using a LECO 850 GDS (glow discharge spectrometer). GDS measurements were conducted on the bulk titanium specimen and are assumed to be representative of the oxygen ingress into the powder particles.

Figure 2:
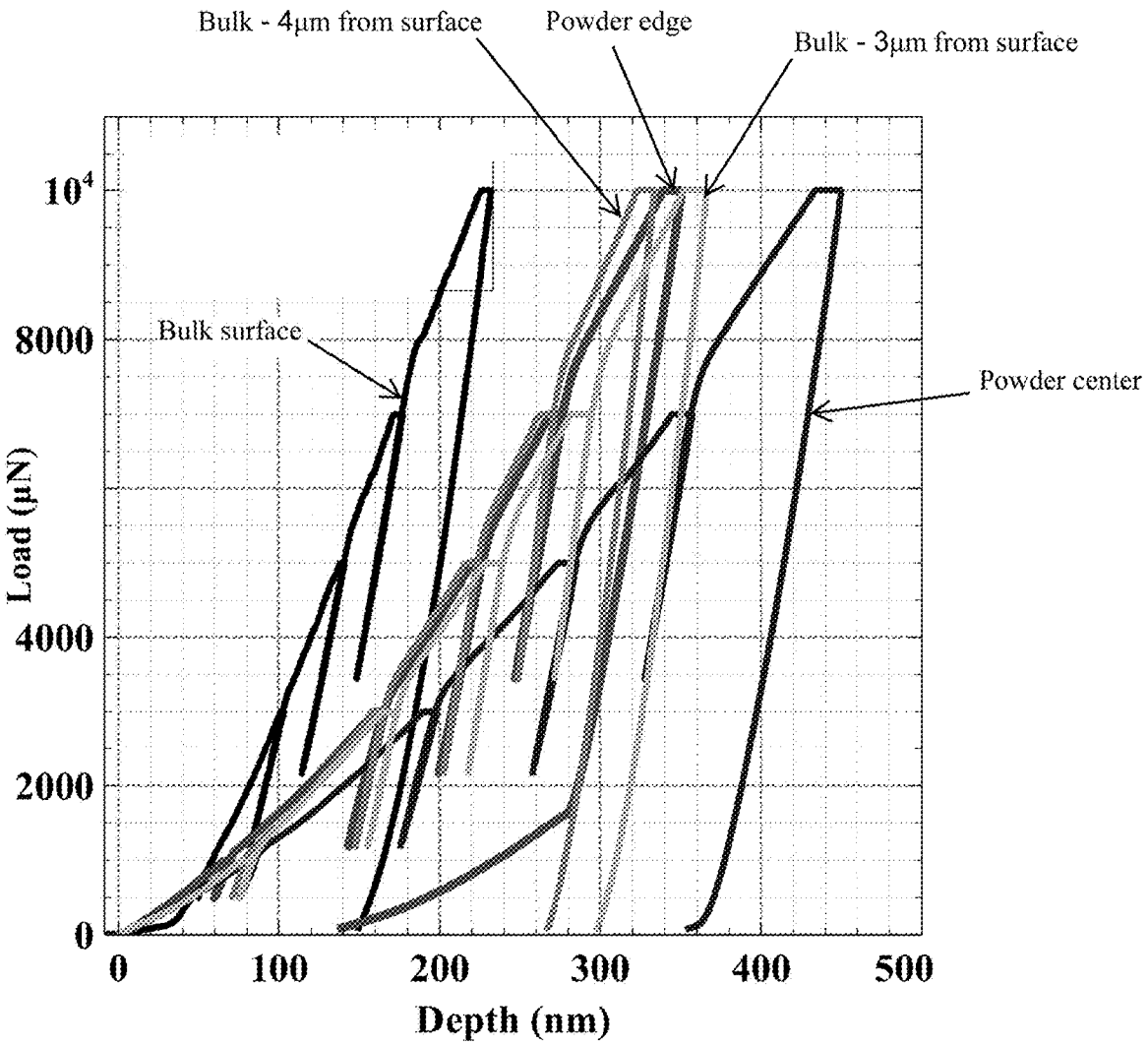
FIG. 2. Load-depth curves from indentations of the bulk titanium specimen and titanium powder sample processed with the same oxidizing treatment. The load depth curve for a typical indentation of the case, about 3 μm from the edge of a spherical particle, is bracketed by indentations between 3 μm and 4 μm deep on the cross section of the bulk material, both of which greatly exceed the hardness of the core.

Hardness measurements from the bulk titanium specimen (FIG. 1A) show that the 530° C. thermal treatment created a hardened layer near the surface. Surface hardness in the bulk titanium specimen increased from about 3.0±0.81 GPa to about 8.4±1.5 GPa. GDS measured an appreciable oxygen concentration within the first 1 μm of the material. This matches the expected penetration depth when using diffusivity data presented by Liu and Welsch, where this heat treatment would produce an oxygen concentration of about 2.88 wt % at a depth of 1 μm. The maximum oxygen concentration does not reach 40 wt % oxygen, which would indicate a complete uniform layer of titanium dioxide ($TiO_2$) had formed on the surface over the entire sampling depth; however, this does not preclude the formation of small islands of oxide. Additionally, no nitrogen was detected on the surface of the bulk titanium specimen treated at 530° C. Nanoindentation experiments on cross sections of the powder also show that there is a clear hardening of the surface (indents were placed within 3 μm of the surface) in relation to the center of powder particles tested (schematically noted in FIG. 1B). Hardness measurements performed on powder and nanoindentation measurements made on the cross section of the bulk titanium specimen show good agreement for the hardness measured at 3 μm from the surface of powder processed at 530° C. Hardness measurements were extracted from the load-displacement data, shown in FIG. 2; the load-depth curves of indentations on the powder cross section at 3 μm from the surface of the powder and indentations on the cross section of the bulk titanium specimen at a distance of 4 μm from the surface are very similar, suggesting there are no deleterious effects from the mounted powder on the frame compliance. This also suggests the surface hardness measured from the bulk titanium specimen should be a valid representation of the powder surface hardness. The hardness of the powder processed at 530° C. at a depth of 3 μm from the edge is approximately 20% higher than the bulk particle hardness, and this difference is statistically significant. The hardness of the powder processed at 430° C. at the same depth from the surface is not statistically different from the center of the powder, indicated the increased hardness in the higher temperature powder must be due to compositional or microstructural changes and not a geometric effect of the measurement method. The hardness, when measured at an indentation depth of about 200 nm is approximately 3 GPa in the as received material, is higher than would be conventionally measured with bulk indentation due to the indentation size effect (about 33-50% increase in hardness at these depths); however the relative differences in hardness between the oxidized and as received materials are statistically significant.

Figure 3:
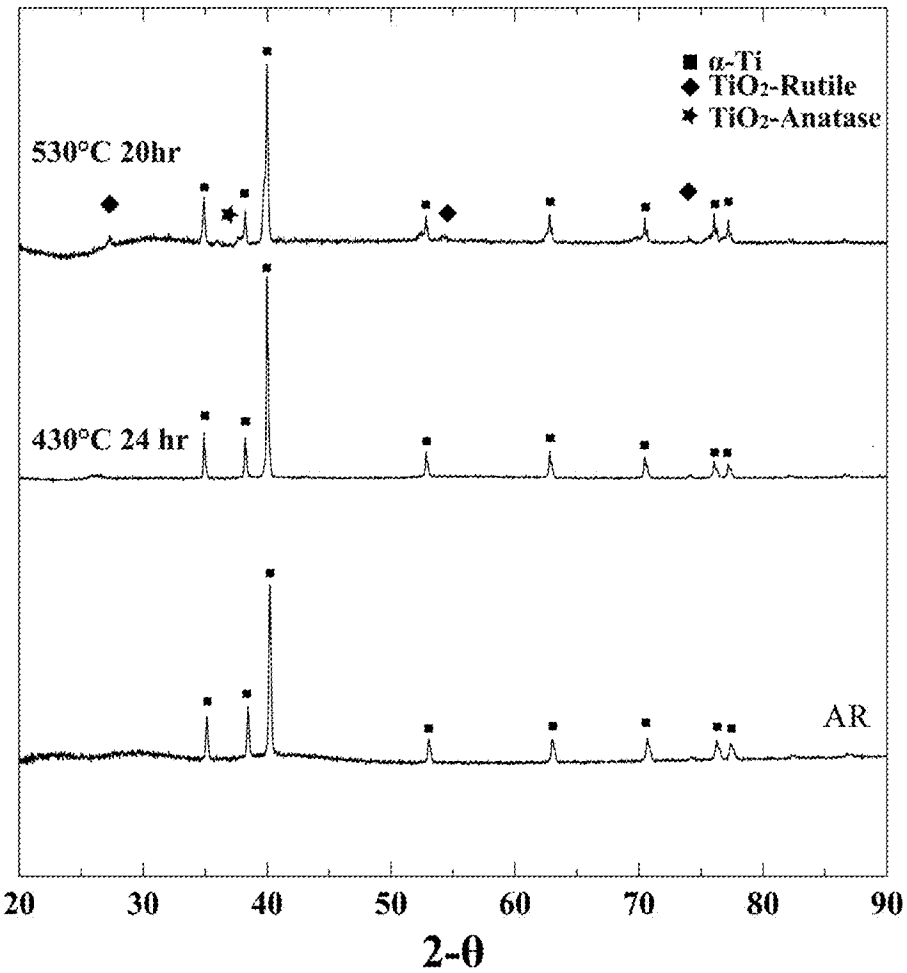
FIG. 3. X-ray spectra taken from powders from as received Cp-Ti powder (AR), and powders subjected to heat exposures at 430° C. for 24 hr and 530° C. 20 hr.

Powder diffraction measurements (see FIG. 3) were conducted on as-received powder (AR), powders processed at 430° C. for 24 hrs, and powders processed at 530° C. for 20 hrs. Powder processed at 430° C. showed no signs of oxide formation, while powder treated at 530° C. showed small peaks attributable to $TiO_2$ at 27.4° and 73.8°2Θ. To determine the relative amounts of metallic α-Ti phase compared to $TiO_2$, the direct comparison method of peaks was used:

$$\frac{I_a}{I_{ox}} = \frac{R_a C_a}{R_{ox} C_{ox}} \quad [1]$$

$$R = \frac{1}{v^2}\left[F^2 p\left(\frac{1+\cos^2(2\theta)}{\sin^2(\theta)\cos(\theta)}\right)\right]e^{-2M}$$

$$C_a + C_{ox} = 1$$

where v is the volume of the lattice, F is the structure factor, p is the multiplicity of the plane chosen. The $e^{-2M}$ factor has been neglected in this study because it is a temperature factor not valid at room temperature. $C_{ox}$ and $C_\alpha$ are the fractions of the oxide and α-Ti phase. Table II shows values used for calculation of the volume fraction.

TABLE II

Values used for volume fraction calculation

| Diffracted peak | v ($nm^3$) | $F^2$ | p |
|---|---|---|---|
| α-Ti-(101) | 0.0351 | 478 | 12 |
| $TiO_2$-(110) | 0.06243 | 1417.65 | 4 |

X-ray spectrum taken from powders processed at 530° C. revealed that there is about 0.03 volume fraction of rutile $TiO_2$. SEM imaging was performed on the powder surfaces (see FIG. 4) to compare changes on the surface that resulted from the heat-exposure. Comparing Images d, e, and f of FIG. 4 shows that the thermal treatment resulted in formation of small and thin islands on the surface of the powder and these become more apparent as time and temperature increased. It should be noted that cross-sectional SEM imaging of powder exposed to 530° C. (see inset in Image c of FIG. 4) does not show clear microstructural evidence of the oxide seen on the surface of the material when compared to the AR powder (Image a of FIG. 4), suggesting that the oxide islands are quite thin. Also the hardening of the powder treated at 530° C. is caused by a combination of oxygen solute in the titanium metal and the formation of oxide islands on the surface. The fact that there is limited oxide would suggest that even if a portion of the power/shot were to be deposited onto the targeted surface, the resulting compositional change to the workpiece would be minimal. This has been verified through GDS depth profiling of titanium shot peened with the treated titanium powder, which shows no evidence of oxide transfer from tire shot to workpiece.

The above results suggest that similar processing could be done on other metals that show appreciable solubility for oxygen in a metallic phase, notably metals that spontaneously form a thin protective oxide layer when exposed to oxidizing conditions due to their affinity to oxygen and as a result generally have very good corrosion resistance properties, referred to sometimes as "valve metals" and include titanium, tantalum, vanadium, and zirconium. Image c of FIG. 4 shows that minor necking occurred between particles during thermal treatment at 530° C., which were easily separated during self-milling conditions and did not lead to significant powder deformation. As such, 530° C. may be considered to approximate an upper end of a processing window for creating a case hardened titanium powder. Cross sections of as-received and material treated at 430° C. exhibit no clear necks and reflect random sections of spheres. As such, ii was concluded that 430° C. lies within the processing window for creating a case hardened titanium powder and may perhaps approximate a lower end of the processing window.

The investigations reported above demonstrated a method of case hardening titanium powder with the potential for creating fine shot peening media suitable for peening articles formed of titanium and its alloys. Though lower processing temperatures and longer/shorter durations may be possible, acceptable time/temperature processing conditions for achieving significant hardening of titanium (almost tripling the surface hardness (about 8 GPa) relative to the core hardness (about 3 GPa)) in ambient atmosphere with no mechanical agitation while not significantly sintering nor significant oxidation of the titanium powder is up to about 530° C. for 20 hours, for example, from about 430° C. for 24 hours up to about 530° C. for 20 hours. Processing temperatures and durations will vary depending on the particular metal, the oxidation start temperature of the metal, and the concentration of oxygen in atmospheres that may be used other than ambient. The effective case depth created with twenty-hour oxidizing at 530° C. is on the order of about 2 to 3 μm, which should be sufficient to harden powders with diameters between 50 and 100 μm. While entirely encasing the particles in an oxide layer is to be avoided in order to avoid oxide contamination, the formation of minor oxide islands appears to be acceptable and oxide islands are not expected to add significantly to the strength of the particle surface. This range of particle size is on the order of the size used for fine peening processes. Very fine particles (for example, on live order of about 5 μm and less) would be sieved out during shot sorting, but may provide interesting systems for future study. While the particles used in the investigation were formed entirely of a titanium alloy, it is foreseeable that acceptable results may be achieved with particles with only the surfaces thereof formed of or containing titanium or another metal that exhibits solubility for oxygen in a metallic phase so as to increase in surface hardness as a result of solid solution strengthening due to oxidizing.

While the invention has been described in terms of particular embodiments and investigations, it should be apparent that alternatives could be adopted by one skilled in the art. For example, process parameters such as temperatures and durations could be modified and appropriate materials could be substituted for those noted. As such, it should be understood that the above detailed description is intended to describe the particular embodiments and certain but not necessarily all features and aspects thereof, and to identify certain but not necessarily all alternatives to the embodiments and described features and aspects. Accordingly, it should be understood that the invention is not necessarily limited to any embodiment described herein, and the phraseology and terminology employed above are for the purpose of describing the disclosed embodiments and investigations and do not necessarily serve as limitations to the scope of the invention. Therefore, the scope of the invention is to be limited only by tire following claims.

The invention claimed is:

1. A process of producing shot peening media, the process comprising:

providing particles wherein at least surfaces of the particles consist of or containing a metal that exhibits solubility for oxygen in a metallic phase so as to increase in surface hardness as a result of solid solution strengthening due to oxidizing of the surfaces of the particles; and subjecting the particles to a thermal process in an oxygen-containing atmosphere at a process temperature and for a process duration sufficient to oxidize the surfaces of the particles to increase the surface hardness of the particles while not forming an oxide layer that encases the particles.

2. The process of claim 1, wherein the surface hardness of the particles is increased by a factor of about three.

3. The process of claim 1, wherein the metal is a valve metal.

4. The process of claim 1, wherein the metal is chosen from the group consisting of titanium, tantalum, vanadium, and zirconium.

5. The process of claim 1, wherein the process temperature of the thermal process is below an oxidation start temperature of the metal.

6. The process of claim 1, wherein the oxygen-containing atmosphere of the thermal process is ambient atmosphere.

7. The process of claim 1, wherein the thermal process is performed with no mechanical agitation of the particles.

8. The process of claim 1, wherein the thermal process is performed without sintering the particles.

9. The process of claim 1, wherein the thermal process results in some sintering of the particles, the process further comprising mechanically agitating the particles to separate sintered particles.

10. The process of claim 1, wherein the metal is titanium, the oxygen-containing atmosphere is ambient atmosphere, and the process temperature is not greater than 530° C.

11. The process of claim 10, wherein the process duration is about 20 hours.

12. The process of claim 10, wherein the process temperature is about 430° C. up to 530° C. and the process duration is about 20 to about 24 hours.

13. The process of claim 1, wherein the surface hardness of the particles is increased to a case depth of about 2 to 3 μm.

14. The process of claim 1, wherein the particles have diameters of about 50 to about 100 μm.

15. The process of claim 1, wherein the surfaces of the particles have oxide islands.

16. The process of claim 1, wherein the particles are entirely formed of the metal.

17. A process comprising peening a surface of an article with particles produced by the thermal process of claim 1, wherein the article is formed of a base metal that is the same as the metal of the particles.

18. The process of claim 17, wherein the article is formed of titanium or an alloy thereof, and the metal of the particles is titanium or an alloy thereof.

19. The process of claim 17, wherein the article is an aerospace, automotive, or biomedical component.

20. Shot peening media comprising particles produced by the thermal process of claim 1.

* * * * *